US009273433B2

(12) United States Patent
Musil

(10) Patent No.: US 9,273,433 B2
(45) Date of Patent: Mar. 1, 2016

(54) METHOD AND APPARATUS FOR CONTROLLING DUST EMISSIONS WITH TEMPERATURE CONTROL

(71) Applicant: Roadtec, Inc., Chattanooga, TN (US)

(72) Inventor: Joseph E. Musil, Ely, IA (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 14/514,881

(22) Filed: Oct. 15, 2014

(65) Prior Publication Data

US 2015/0104255 A1 Apr. 16, 2015

Related U.S. Application Data

(60) Provisional application No. 61/891,635, filed on Oct. 16, 2013, provisional application No. 61/945,602, filed on Feb. 27, 2014.

(51) Int. Cl.
*E01C 23/14* (2006.01)
*E01C 23/088* (2006.01)

(52) U.S. Cl.
CPC ..... *E01C 23/088* (2013.01); *E01C 2301/50* (2013.01)

(58) Field of Classification Search
USPC ..... 404/94, 95
IPC ..... E01C 23/127,23/14
See application file for complete search history.

(56) References Cited

U.S. PATENT DOCUMENTS

| | | | | |
|---|---|---|---|---|
| 4,175,885 | A | 11/1979 | Jeppson | |
| 4,325,580 | A | 4/1982 | Swisher, Jr. et al. | |
| 4,557,626 | A | 12/1985 | McKay et al. | |
| 4,793,730 | A | 12/1988 | Butch | |
| 6,619,881 | B1 | 9/2003 | Harvey | |
| 6,619,882 | B2 | 9/2003 | Harvey | |
| 7,175,364 | B2 | 2/2007 | Gaertner et al. | |
| 7,219,964 | B2 | 5/2007 | Berning et al. | |
| 7,300,225 | B2 * | 11/2007 | Musil | 404/79 |
| 7,458,645 | B2 | 12/2008 | Hall et al. | |
| 7,473,052 | B2 | 1/2009 | Hall et al. | |
| 7,854,566 | B2 * | 12/2010 | Hall et al. | 404/111 |
| 7,976,238 | B2 * | 7/2011 | Hall et al. | 404/83 |
| 7,976,239 | B2 * | 7/2011 | Hall et al. | 404/94 |
| 8,220,875 | B2 | 7/2012 | Cipriani | |
| 8,403,595 | B2 * | 3/2013 | Hall et al. | 404/129 |

(Continued)

FOREIGN PATENT DOCUMENTS

| | | |
|---|---|---|
| GB | 850946 | 10/1960 |
| JP | 2-104804 | 4/1990 |

*Primary Examiner* — Gary Hartmann
(74) *Attorney, Agent, or Firm* — Chambliss, Bahner & Stophel, P.C.

(57) ABSTRACT

A working machine for use in milling the surface of a road includes a drive engine that produces engine exhaust gases. The working machine also includes a milling drum that is mounted for rotation against the surface of the road so as to generate milled material including dust from the road surface. The milling drum is contained within a milling chamber, and a spray assembly directs water into the milling chamber in such a manner that, during a period of rotation of the milling drum against the surface of the road, at least a portion of the water is converted to a vapor. A conduit is provided for conducting at least a portion of the engine exhaust gases into an enclosed space in communication with the milling chamber to raise the temperature of a gas stream therein containing vapor and dust from the milled material.

18 Claims, 9 Drawing Sheets

(56) References Cited

U.S. PATENT DOCUMENTS 8,485,756 B2 * 7/2013 Hall et al. ..... 404/94
8,985,701 B2 * 3/2015 Denson et al. ..... 299/39.2
2011/0062357 A1 3/2011 Pohl et al.
2012/0324754 A1 * 12/2012 Friesen et al. ..... 34/406
2013/0081898 A1 4/2013 Lubischer et al.
2013/0312733 A1 * 11/2013 Sorken ..... 126/271.2 R

* cited by examiner

METHOD AND APPARATUS FOR CONTROLLING DUST EMISSIONS WITH TEMPERATURE CONTROL

CROSS-REFERENCE TO RELATED APPLICATION

This application claims the benefit of U.S. Provisional Patent Application No. 61/891,635 which was filed on Oct. 16, 2013, and U.S. Provisional Patent Application No. 61/945,602 which was filed on Feb. 27, 2014.

FIELD OF THE INVENTION

This invention comprises a method and apparatus for raising the temperature of a gas stream that may contain water vapor and dust in a system, in a controlled manner, to a temperature at which mudding does not occur. The invention is useful for preventing ductwork mudding in systems without filtration devices and also in systems with filtration devices.

BACKGROUND OF THE INVENTION

A road milling machine includes a milling drum with a plurality of cutter teeth mounted thereon which is contained within a milling enclosure or chamber. The milling machine is adapted to be advanced across a road surface to "mill" the surface to remove asphaltic or Portland cement concrete road pavement in preparation for recycling the pavement and/or in preparation for applying a pavement overlay. Road milling machines can also be used to "profile" or make smooth an asphalt or concrete road surface. The typical milling machine includes one or more conveyors to take the milled material from the vicinity of the milling drum and direct it away from the machine and into an adjacent dump truck. A road stabilizer/reclaimer machine is similar to a milling machine in that it comprises a wheeled or track-driven vehicle that includes a milling drum with a plurality of cutter teeth mounted thereon which is contained within a milling enclosure or chamber. However, the milling drum of a road stabilizer/reclaimer machine is generally employed to mill or pulverized an existing road bed or roadway to a greater depth than does a milling machine prior to repaving (usually called reclaiming) or prior to initial paving (usually called stabilizing), and it leaves the pulverized material in place. During the operation of a milling machine or a road stabilizer/reclaimer machine, the surface pavement is broken by the cutter teeth of the milling drum, thereby generating dust in the milling chamber.

The cutter teeth on the milling drum of a milling machine or a road stabilizer/reclaimer machine are typically made of metallic carbides or other very hard materials. As these teeth are forced through the road surface as the milling drum is rotated, they are heated by friction to a high temperature. A water spray bar with nozzles is typically mounted within or adjacent to the milling chamber to direct water to cool the hot cutter teeth and/or to control dust emissions. When this cooling water hits the cutter teeth, some of the water is turned into steam. The change in phase of water to steam creates volumetric expansion, and some of the dust and gas stream contents of the milling chamber can be blown out through gaps between the milling chamber and the road surface. Some of the dust that is blown out of or escapes the milling chamber of a milling machine or a road stabilizer/reclaimer machine can contain silica, which in certain forms comprises a health concern for the machine operators and other nearby personnel. To minimize or prevent the escape of the particulate silica and other dust from the milling chamber, it is known to equip the working machine with an emission control system. In some such systems, the dust and its entraining gas stream are routed to an area of safe discharge or to a dust separation device such as a filter assembly where the dust is separated from the entraining gas stream. In some such systems, the milling chamber is placed under a negative pressure using a fan device.

The critical importance of the temperature of the gas stream that contains water in a vapor (gaseous) state and dust generated during milling of a roadway for the efficient operation of an emission control system has not been appreciated. If the temperature of the gas stream is not high enough, the temperature of the gaseous water vapor in the gas stream may fall below its dew point so that the water vapor will condense to a liquid state. This can lead to mudding and fouling of ductwork and to mudding and fouling of separation and filtering devices such as cartridge filters, cyclones, baghouses and other devices. It would be advantageous if a method and apparatus could be developed for control of the temperature of the gas stream entraining dust generated during the milling of a roadway to insure efficient operation of an associated emission control system. Although the invention described herein may be employed in connection with an emission control system including a dust collection device in a working machine such as a milling machine or a road stabilizer/reclaimer machine, it may also be employed in connection with emission control systems with no dust collection device.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "water" refers to a fluid that is primarily or wholly comprised of water or a solution, emulsion or mixture in which water is the primary component.

The terms "steam", "water vapor", "vapor" and similar terms refer to water in a gaseous state.

The term "gas stream" refers to a stream or flow of a gas which may include air and water vapor.

The term "dust" refers to particulate material that can be entrained in a gas stream.

The term "working machine" refers to a milling machine and/or a stabilizer/reclaimer machine and/or any other road working machine that includes a milling drum and a spray assembly for use in dispensing water for heat and/or dust control.

The terms "upper", "top" and similar terms, when used in reference to a relative position or direction on or with respect to a working machine, or a component or portion of such a machine, refer to a relative position or direction that is farther away from the surface on which the working machine is placed for operation.

The terms "lower", "bottom" and similar terms, when used in reference to a relative position or direction on or with respect to a working machine, or a component or portion of such a machine, refer to a relative position or direction that is nearer to the surface on which the working machine is placed for operation.

The term "front end" and similar terms, when used in connection with a working machine or a component or portion of such a machine, refer to the end of the machine, or the component or portion thereof which is in the direction of travel of the machine while it is being operated.

The terms "forward", "in front of", and similar terms, as used herein to describe a relative position or direction on or in connection with a working machine, or a component or portion of such a machine, refer to a relative position or direction towards the front end of the machine.

The terms "back end", "rear end" and similar terms, when used in connection with a working machine or a component or portion of such a machine, refer to the end of the machine or the component or portion thereof which is farther from the front end of the working machine.

The terms "rearward", "behind", and similar terms, as used herein to describe a relative position or direction on or in connection with a working machine, or a component or portion of such a machine, refer to a relative position or direction towards the rear end of the machine.

The term "linear actuator" refers to an electric, hydraulic, electro-hydraulic or mechanical device that generates force which is directed in a straight line. One common example of a "linear actuator" is a hydraulic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The term "rotary actuator" refers to an electric, hydraulic or electro-hydraulic motor or other device that generates force that is directed along an arc or about a center of rotation.

The term "actuator" refers to a linear actuator or a rotary actuator.

SUMMARY OF THE INVENTION

The invention comprises a working machine for use in milling the surface of a road, which working machine includes a drive engine that produces engine exhaust gases and a milling drum that is mounted for rotation against the surface of the road so as to generate milled material including dust from the road surface. The milling drum is contained within a milling chamber, and a spray assembly is provided for directing water into the milling chamber in such a manner that, during a period of rotation of the milling drum against the surface of the road, at least a portion of the water is converted to a vapor. An enclosed space comprises the milling chamber, and a conduit is provided for conducting at least a portion of the engine exhaust gases into the enclosed space to raise the temperature of a gas stream therein containing vapor and dust from the milled material.

The invention also comprises a method for operating such a working machine by conducting at least a portion of the heat from the engine exhaust gases into the enclosed space to raise the temperature of a gas stream therein containing vapor and dust from the milled material.

In order to facilitate an understanding of the invention, the preferred embodiments of the invention, as well as the best modes known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which.

DETAILED DESCRIPTION OF THE PREFERRED EMBODIMENTS

Figure 1:
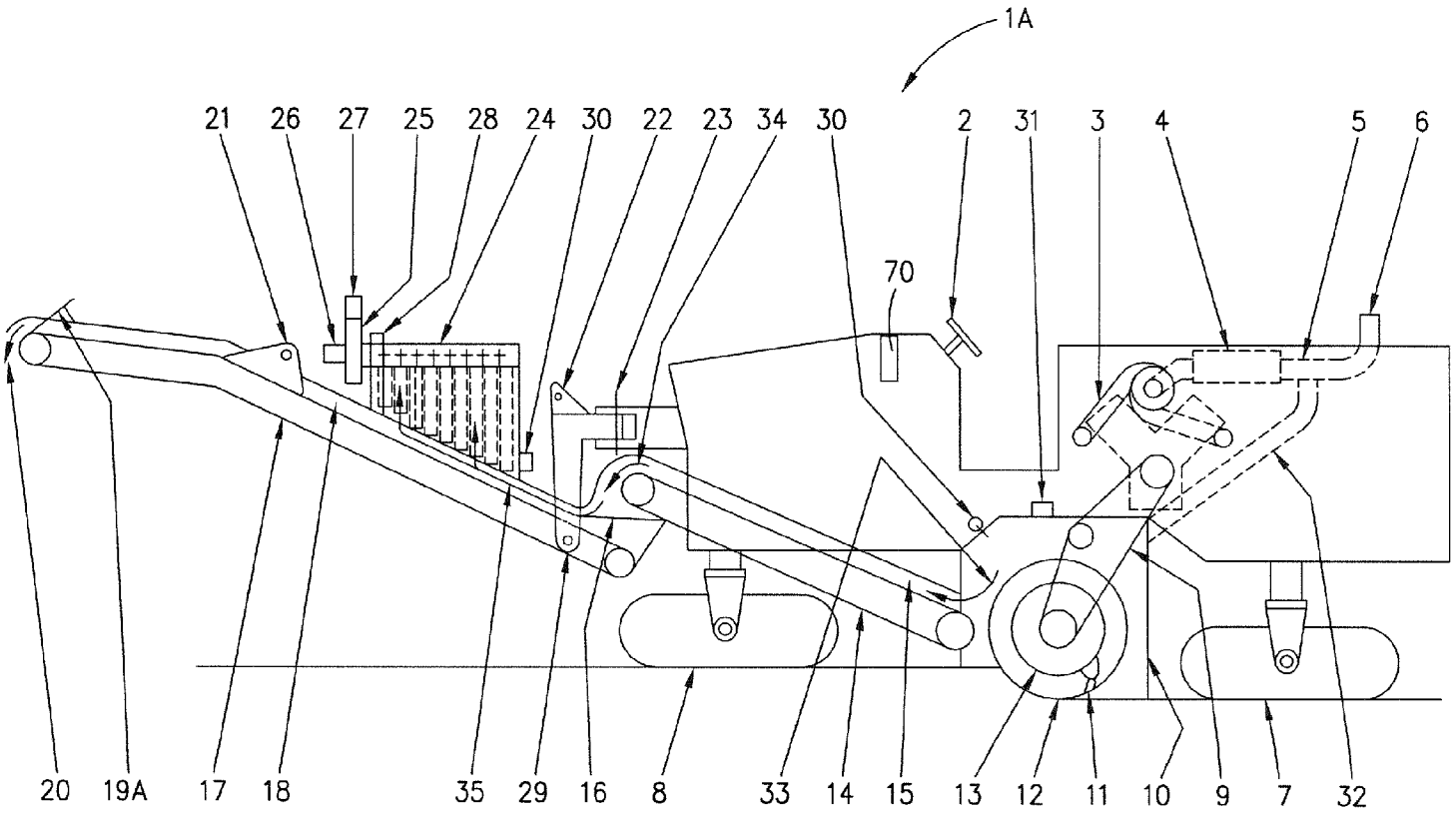
FIG. 1 is a side view, partially in section, of a milling machine that is equipped with an embodiment of the invention.

Milling machines 1A, 1B, 1C and 1D, all of which are similar, are illustrated in FIGS. 1-4, respectively. Each of these milling machines includes operator's station 2 and engine 3, typically a diesel engine. Operator's station 2 includes all of the controls necessary for driving and steering the milling machine, rotating milling drum 13, and controlling certain aspects of the invention, as explained hereinafter. Power from engine 3 is transmitted by drive belt 9 to milling drum 13, which is located in enclosed milling chamber 10. Milling drum 13 includes a plurality of cutter teeth 11 that are adapted to mill the road surface as the milling drum rotates and the machine is advanced along the roadway. The bottom 12 of the milling cut path coincides with the lower portion of the circular cutter tooth path inscribed by the plurality of cutter teeth 11 as milling drum 13 rotates.

Power from engine 3 is also transmitted by means known to those having ordinary skill in the art to which the invention relates to rear track assembly 7 and front track assembly 8. Milling machines 1A, 1B, 1C and 1D may include one or two rear tracks, each of which can be turned to the left and to the right for steering purposes. Most commonly, these rear tracks can also be raised and lowered relative to the machine main frame. Typically, there are also two front track assemblies (such as assembly 8), each of which can be turned to the left and to the right for steering purposes, and each of which can also be raised and lowered relative to the machine main frame. Other embodiments of working machines (not shown in the drawings) include wheel drive assemblies.

Milling chamber 10 has front, rear and side slide covers that contact the road surface and provide a seal against the escape of dust when maintained against the road surface. Milled material is carried up and around the interior of the milling chamber by rotation of the drum and passes through an opening on the front wall, as indicated by arrow 33, where it is deposited onto the first conveyor 14. Manifold 30 includes a plurality of nozzles which are in fluid communication with a source of water (not shown) to allow cooling water to be sprayed into the milling chamber to cool cutting teeth 11.

In the preferred embodiments of the milling machines illustrated in the drawings, fan 25 is provided to create negative (or suction) pressure within the milling chamber (as described in more detail hereinafter). A first sensor is mounted at sensor location 31 in the milling chamber to measure the level of negative pressure in the chamber. In the preferred embodiments of the invention, a second sensor is also mounted at location 31 to measure the temperature within the milling chamber. In other embodiments of the invention, the first and second sensors may be located in alternative locations, such as (but not limited to) a location on top of enclosure 18 for conveyor 17, or adjacent to either end of duct 38 (in machine 1B, shown in FIG. 2 or machine 1D, shown in FIG. 4), or in baghouse 24. Those having ordinary skill in the art to which the invention relates may choose sensor locations for particular embodiments to obtain the most accurate readings. Displays for these sensors are provided at operator's station 2.

First conveyor 14 is enclosed by enclosure 15, which is preferably provided with seals that contact the conveyor belt, commonly called flashings, so that the space above the belt of first conveyor 14 within enclosure 15 defines a first enclosed duct through which a gas stream can pass. This enclosed duct is in communication with the milling chamber so that the combination of the milling chamber and the first enclosed duct comprises an enclosed space.

Milled material is conveyed off the forward end of first conveyor 14 onto second conveyor 17, and off the forward end of second conveyor 17 (as material 20) into a truck. Second conveyor 17 is mounted with respect to first conveyor 14 so as to be pivotable about horizontal pivot 29. A linear actuator (not shown) may be mounted between pivot points 21 and 22 to raise and lower the forward end of second conveyor 17. Second conveyor 17 also is adapted to pivot about a vertical axis through conveyor connector 23 to the left or to the right with respect to the direction of travel of the milling machine so that its forward end may be moved into alignment with an adjacent truck.

Second conveyor 17 is preferably enclosed by enclosure 18, which is provided with seals or flashings that contact the conveyor belt so that the space above the belt of second conveyor 17 within enclosure 18 defines a second enclosed duct through which a gas stream can pass. This enclosed duct is in communication with the milling chamber and with the first enclosed duct so that the combination of the milling chamber, the first enclosed duct and the second enclosed duct comprises an enclosed space.

In milling machine 1A (FIG. 1) and milling machine 1C (FIG. 3), first conveyor 14 and second conveyor 17 are connected by a sealed swivel connection joint 16. Connection joint 16 allows second conveyor 17 to move left and right and to raise and lower the height of its forward end while maintaining a sealed connection to first conveyor 14. Thus, these two conveyors and their enclosures form a continuous enclosed duct through which dust, air and other gases are conveyed from the milling chamber onto first conveyor 14, and then onto second conveyor 17, as indicated by arrow 34, without requiring any external hoses. In milling machine, 1B (FIG. 2) and milling machine 1D (FIG. 4), the swivel connection joint 16 is omitted, and one or more connector hoses 38 are employed to convey gases and entrained dust from the enclosure for first conveyor 14 to the enclosure for second conveyor 17. In the embodiments of the invention illustrated in FIGS. 2 and 4, connector hoses 38 comprise a part of the enclosed space which also includes the milling chamber, the first enclosed duct and the second enclosed duct.

Figure 5:
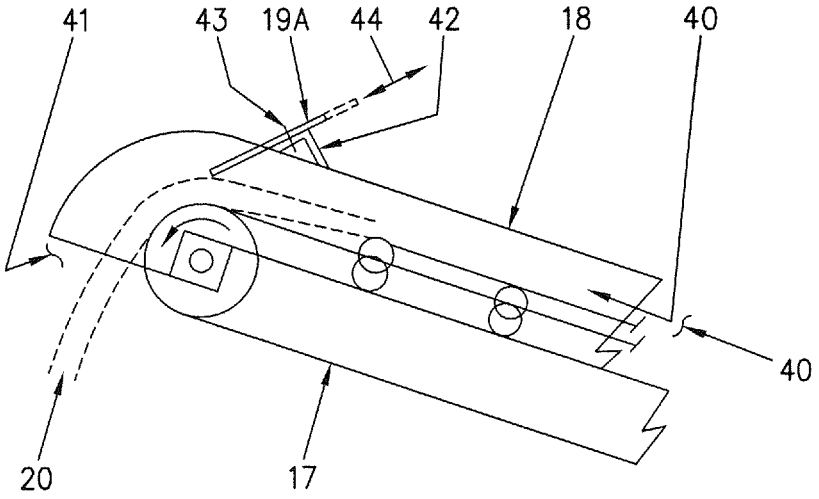
FIG. 5 is a side view, partially in section, of an adjustable damper plate of the embodiments of the invention shown in FIGS. 1 and 2.

In milling machine 1A and milling machine 1B, a gas stream blocking device such as adjustable damper plate 19A (also shown in FIG. 5) is mounted on support 42 at the forward end of second conveyor 17 so as to be moveable forwards and backwards along axis 44 (shown in FIG. 5). Locking bolt or pin 43 is provided to cooperate with corresponding holes in damper plate 19A and support 42 so that the damper plate may be locked in any of multiple positions, provided, however, that the damper plate may not be extended into enclosure 18 far enough to impede the flow of material 20 off of second conveyor 17. In the alternative, slots may be provided in damper plate 19A, so that a locking bolt may be placed in any of various positions through the slot in the damper plate and into a hole in support 42 to increase the number of positions that the damper plate may be located within the enclosure. However, it is intended that the damper plate be located with respect to enclosure 18 in a position that will block a substantial portion of the gas flow above material 20 in the enclosure. Consequently, as illustrated in FIG. 5, adjustable damper plate 19A helps to keep air 41 at atmospheric pressure from entering the reduced pressure area 40 behind the damper plate. The pressure in area 40 is lower than ambient atmospheric pressure (indicated at 41) because of the suction created by fan 25 (as described in more detail hereinafter). In other embodiments of the invention (not shown in the drawings), enclosure 18 may be arranged and configured so that there is little space above material stream 20 on second conveyor 17. In such embodiments, adjustable damper plate 19A may not be needed.

Figure 6:
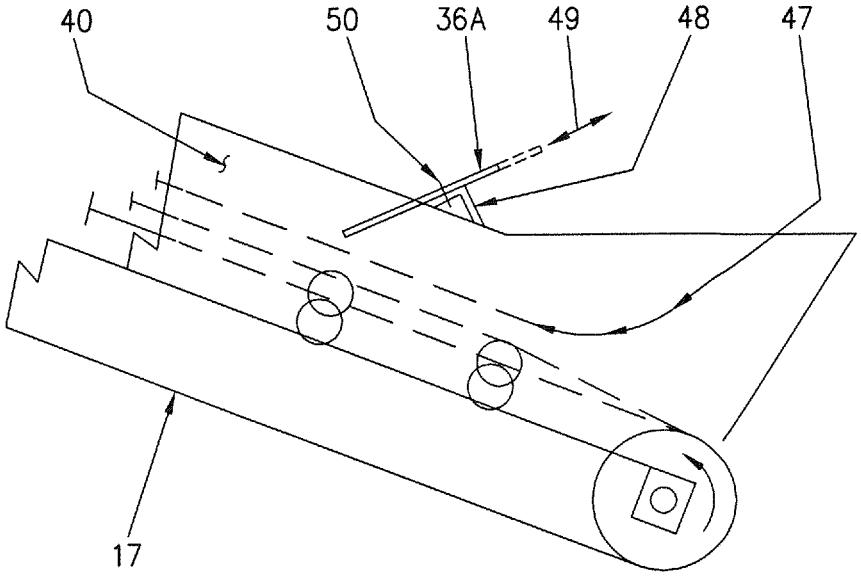
FIG. 6 is a side view, partially in section, of an adjustable damper plate of the embodiment of the invention shown in FIG. 2.

Another gas stream blocking device such as adjustable damper plate 36A (shown in FIGS. 2 and 6) is mounted on support 48 at the rear end of second conveyor 17 on machine 1B, so as to be moveable forwards and backwards along axis 49. Locking bolt or pin 50 is provided to cooperate with corresponding holes in damper plate 36A and support 48 so that the damper plate may be locked in any of multiple positions, provided, however, that the damper plate may not be extended into enclosure 18 far enough to impede the flow of material 47 onto second conveyor 17. Slots may be provided in damper plate 36A to allow the damper plate to be locked in an infinite number of positions with respect to support 48. However, it is intended that the damper plate be located with respect to enclosure 18 in a position that will block a substantial portion of the air flow above material 47 in the enclosure.

Another gas stream blocking device such as adjustable damper plate 19B is mounted on a support (similar to support 42 shown in FIG. 5) at the forward end of first conveyor 14 of milling machine 1B so as to be moveable forwards and backwards along an axis (similar to axis 44 shown in FIG. 5). A locking bolt or pin (similar to locking pin 43) is provided to cooperate with corresponding holes in damper plate 19B and its support so that the second damper plate may be locked in any of multiple positions, provided, however, that this damper plate 19B may not be extended into enclosure 15 far enough to impede the flow of milled material off of first conveyor 14. In the alternative, slots may be provided in damper plate 19B so that the damper plate can be locked in an infinite number of positions with respect to the support. However, it is intended that damper plate 19B be located with respect to enclosure 15 in a position that will block a substantial portion of the gas flow above the milled material in the enclosure. Adjustable damper plate 19D (shown in FIG. 4) is located at the front end of first conveyor 14 on machine 1D, and is essentially identical to adjustable damper plate 19B on machine 1B.

The combination of adjustable damper plate 36A, adjustable damper plate 19A and adjustable damper plate 19B on machine 1B helps to keep the gas pressure in area 40 (shown in FIGS. 5 and 6) below that of atmospheric pressure. In other embodiments of the invention (not shown in the drawings), enclosure 18 may be arranged and configured so that there is little space above material stream 47 on second conveyor 17. In such embodiments, an adjustable damper plate (such as damper plate 36A of machine 1B) may not be needed. Similarly, enclosure 15 may be arranged and configured so that there is little space above the milled material stream on first conveyor 14 of machine 1B. In such embodiments, an adjustable damper plate (such as damper plate 19B of machine 1B) may not be needed.

Figure 7:
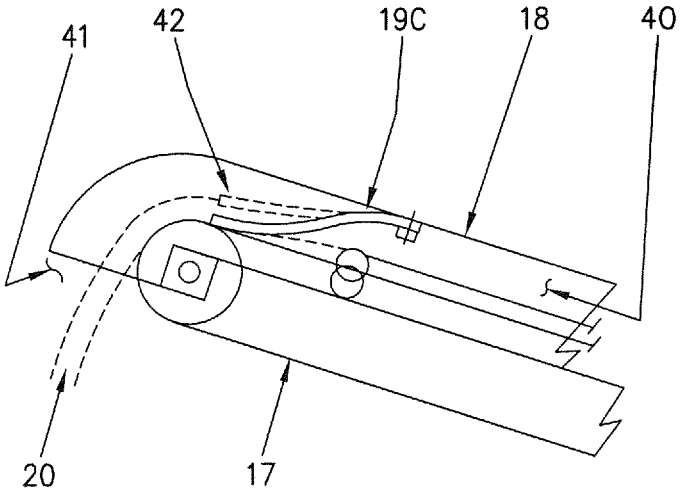
FIG. 7 is a side view, partially in section, of a flap seal of the embodiments of the invention shown in FIGS. 3 and 4.

In milling machine 1C (FIG. 3) and milling machine 1D (FIG. 4), a gas stream blocking device comprising flap seal 19C is located at the forward end of second conveyor 17 and is illustrated in more detail in FIG. 7. As shown therein, the static gas pressure inside enclosure 18 is indicated at 40. This pressure is lower than ambient pressure (indicated at 41) because of the suction created by fan 25 (as described in more detail hereinafter). Because pressure 40 within the enclosure is lower than pressure 41 on top of the flap seal, there is a downward force on the top of flap seal 19C which tends to help hold it against the forward end of second conveyor 17 while allowing material 20 to pass under it. In other words the flap seal lets material out, but does not let air in. As shown in FIG. 7, the raised position of flap seal 19C when material 20 is passing underneath is indicated at 42.

Figure 8:
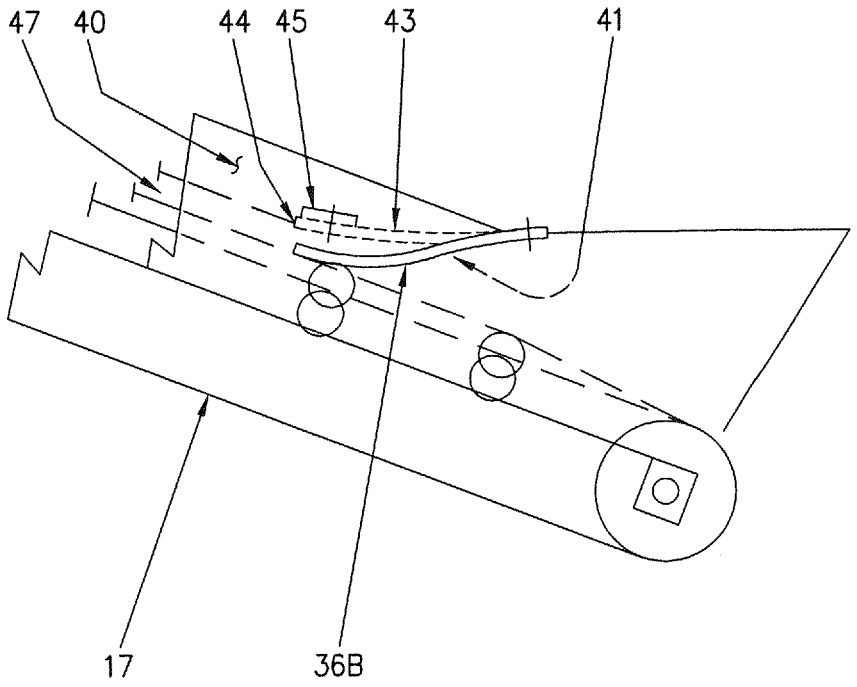
FIG. 8 is a side view, partially in section, of a flap seal of the embodiment of the invention shown in FIG. 4.
Figure 9A:
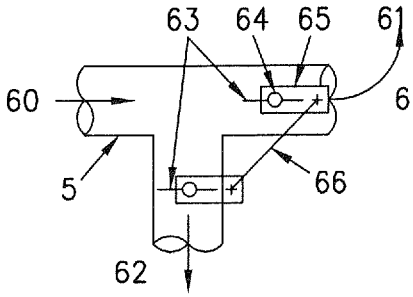
FIG. 9A illustrates a dual damper embodiment of the exhaust metering valve of a preferred embodiment of the invention in which dampers are provided in the exhaust port and the emission system supply port, and the dampers are shown in the first position.
Figure 9B:
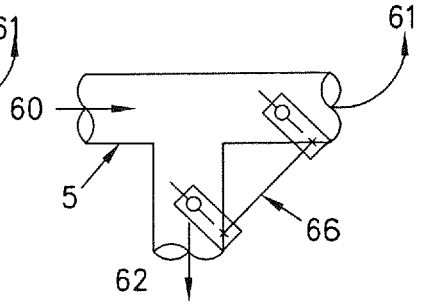
FIG. 9B illustrates the dual damper embodiment of FIG. 9A, but with the dampers shown in the second position.
Figure 10A:
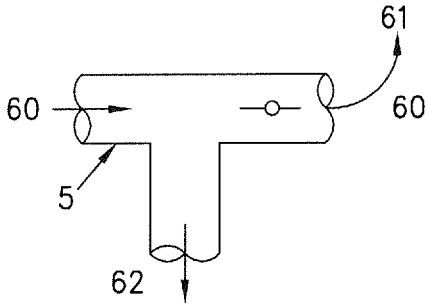
FIG. 10A illustrates a single damper embodiment of the exhaust metering valve of a preferred embodiment of the invention in which the damper is provided in the exhaust port, and the damper is shown in the first position.
Figure 10B:
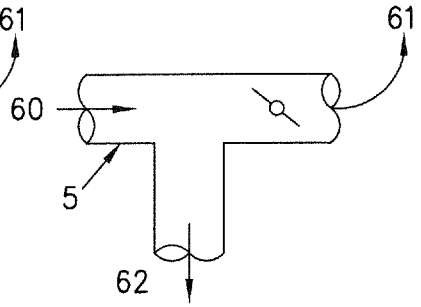
FIG. 10B illustrates the single damper embodiment of FIG. 10A, but with the damper shown in the second position.
Figure 11A:
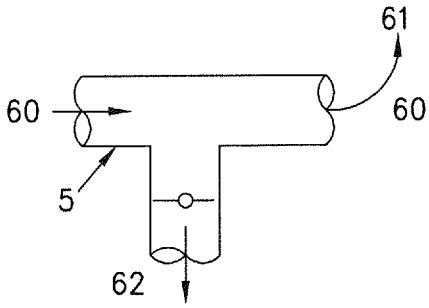
FIG. 11A illustrates a single damper embodiment of the exhaust metering valve of a preferred embodiment of the invention in which the damper is provided in the emission system supply port, and the damper is shown in the first position.
Figure 11B:
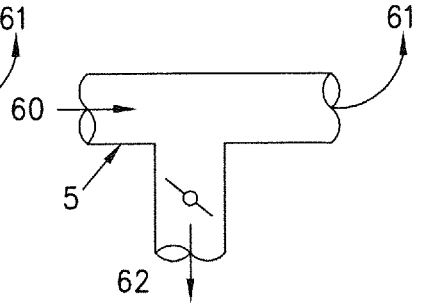
FIG. 11B illustrates the single damper embodiment of FIG. 11A, but with the damper shown in the second position.

Another gas stream blocking device comprising flap seal 36B is also employed in milling machine 1D at the rear end of second conveyor 17. In this location as shown in FIG. 8, the air pressure on top of the flap seal, indicated at 43, is slightly lower than atmospheric pressure because of the suction created by fan 25. As shown in more detail in FIG. 8, milled material 47 enters second conveyor 17, passing under flap seal 36B, thereby raising the flap seal (as indicated at 44) to allow the material to pass. Preferably, a weight or mass 45 is placed atop flap seal 36B to hold the flap seal down against the lifting force created by the pressure difference. Another flap seal 19D, similar in all respects to flap seal 19C and flap seal 36B, is mounted at the forward end of first conveyor 14 of milling machine 1D. The combination of flap seals 36B, 19C and 19D on machine 1D helps to keep the gas pressure within enclosure 18 above second conveyor 17 below that of atmospheric pressure.

In the milling machines illustrated in FIGS. 1-4, the exhaust gases from engine 3 are directed through exhaust gas treatment device 4, which may comprise a muffler and/or an emission treatment system such as a diesel particulate filter ("DPF"), a selective catalytic reactor ("SCR") and/or any other treatment device suitable for use in treating the exhaust from engine 3. Exhaust metering valve 5 is located before the outlet of exhaust stack 6 so that a portion of the high-temperature engine exhaust gases can be intercepted before passing through stack 6. In milling machines 1A and 1C, valve 5 permits exhaust gases to be conveyed via conduit 32 to milling chamber 10. In milling machines 1B and 1D, valve 5 allows a portion of the high-temperature engine exhaust gases to be routed via conduit 37 to enclosure 15 over first conveyor 14. In either case, the temperature and the dew point of the gases in the enclosed space of the invention will be raised. Controller 70, which is adapted to control the operation of the invention, can be programmed to operate valve 5 so that engine exhaust gases will only pass through conduit 32 or conduit 37 when fan 25 is operating and milling drum 13 is rotating. Exhaust gases not diverted by valve 5 can be exhausted to the atmosphere through exhaust stack 6. In other embodiments of the invention (not shown), valve 5 may be replaced with a heat exchanger to transfer heat from the engine exhaust gases to other gases in the system.

FIGS. 9A and 9B, 10A and 10B, and 11A and 11B illustrate three variations of valve 5, each in two different positions. Other valve styles and methods of control may also be used. For all three embodiments illustrated in FIGS. 9A and 9B, 10A and 10B, and 11A and 11B, exhaust metering valve 5 is located downstream of engine 3 and inlet 60. Outlet 61 leads to stack 6, and gas bypass outlet 62 leads to conduit 32 in milling machines 1A and 1C, or to conduit 37 in milling machines 1B and 1D. The gases passing through gas bypass outlet 62 are mixed with the gases in the enclosed space comprising the milling chamber (FIGS. 1 and 3) or the enclosure 15 (FIGS. 2 and 4) to raise the temperature of gases therein above their dew point, thereby minimizing or eliminating mudding buildup in housings, ducts and filters.

Figure 2:
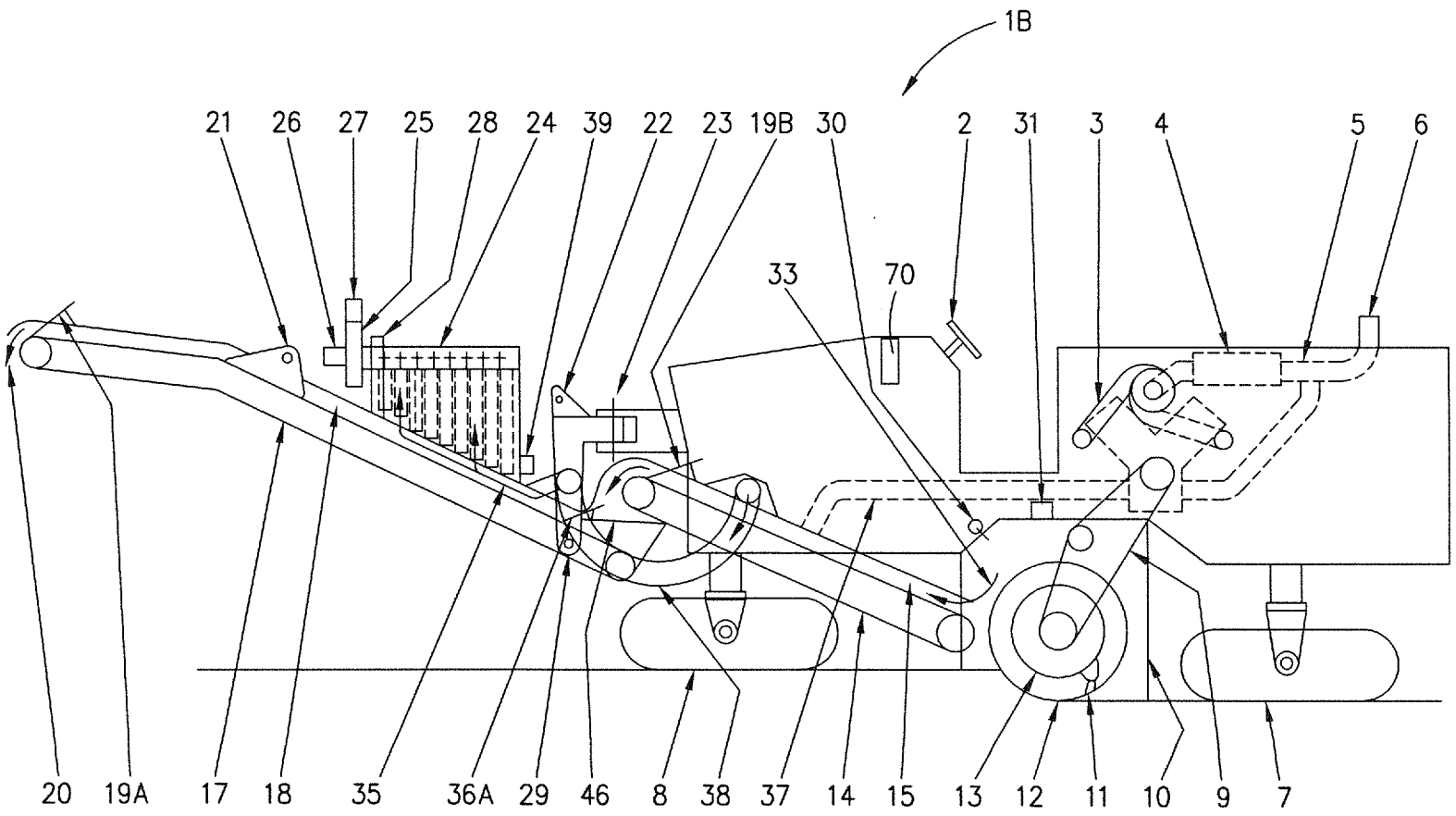
FIG. 2 is a side view, partially in section, of a milling machine of a different configuration from that of FIG. 1 that is also equipped with an embodiment of the invention that is similar to that of the embodiment of FIG. 1.
Figure 3:
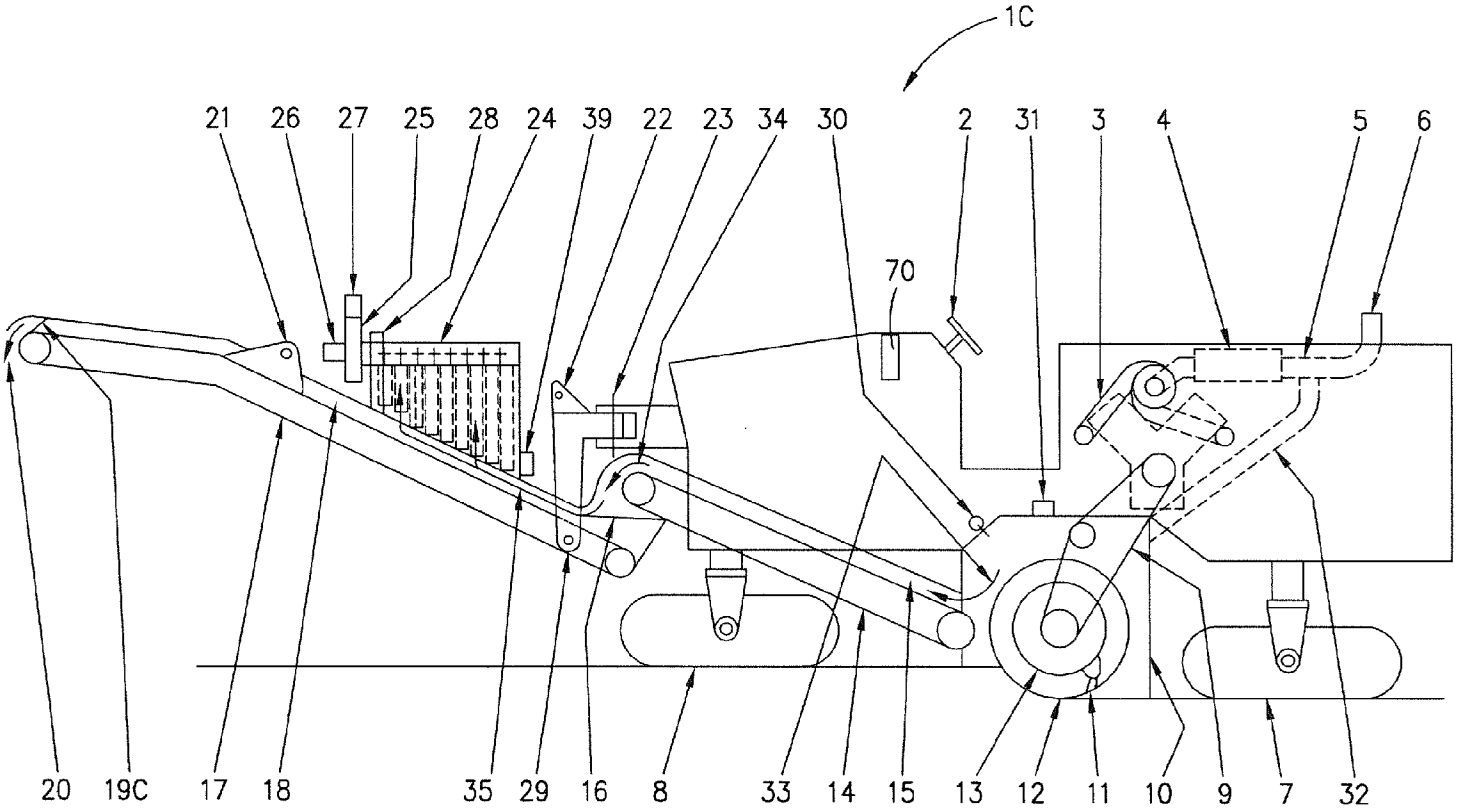
FIG. 3 is a side view, partially in section, of a milling machine that is equipped with another embodiment of the invention.
Figure 4:
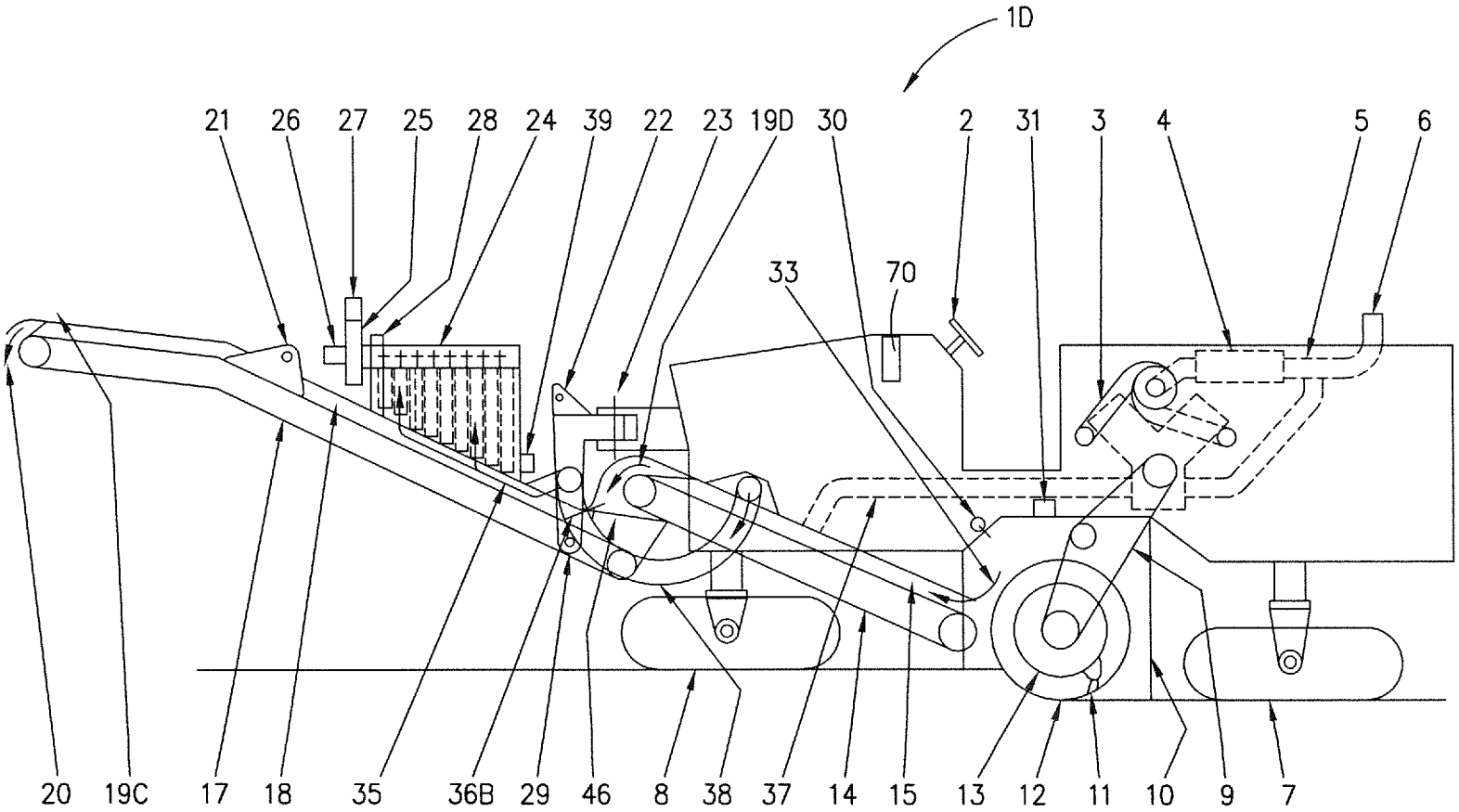
FIG. 4 is a side view, partially in section, of a milling machine of a different configuration from that of FIG. 3 that is also equipped with an embodiment of the invention that is similar to that of the embodiment of FIG. 3.

Each embodiment of valve 5 comprises one or more dampers 62 that are mounted on damper shafts 64. The dampers are adapted to be moved between positions in which exhaust gases are allowed to pass through outlet 61 to stack 6 (shown in FIGS. 9A, 10A and 11A) and positions in which at least a portion of the exhaust gases are diverted (shown in FIGS. 9B, 10B and 11B) to conduit 32 (FIGS. 1 and 3) or conduit 37 (FIGS. 2 and 4). In the embodiment shown in FIGS. 9A and 9B, a damper is placed in both outlet 61 and outlet 62. Linkage arm 65 connects one damper shaft to another and/or acts as a positioning drive motor (not shown). Connecting link 66 can be adjustable so as to change the relationship of one damper plate to another or to a drive positioning motor. An actuator (not shown) moves the dampers in response to control signals. In the embodiment shown in FIGS. 10A and 10B, a single damper is placed in outlet 61. An actuator (not shown) moves the damper in response to control signals. In the embodiment shown in FIGS. 11A and 11B, a single damper is placed in outlet 62. An actuator (not shown) moves the damper in response to control signals.

In preferred embodiments of the invention, a filter device such as baghouse 24 is mounted on top of enclosure 18, and an opening or passageway is provided from the enclosure into the baghouse, so that air and other gases entraining dust being conveyed through the enclosed space comprising enclosure 18 will pass upwardly into the baghouse, as indicated by arrow 35. Fan 25 may be operated by motor 26 to provide a negative pressure in enclosure 18, thereby drawing gases and entrained dust into baghouse 24. Fan 25 is located at the outlet end of the baghouse in the embodiments of the invention illustrated in the drawings, and is adapted to be controlled from operator's station 2. The location of the fan at the outlet end of the baghouse in the embodiments of the invention illustrated in the drawings is advantageous because it allows the fan to operate in clean air and to pull gases and dust through the baghouse. However, the fan could alternatively be placed upstream of the baghouse to blow gases and entrained dust into the baghouse.

In the baghouse, gases entraining dust are drawn through a permeable media. The dust is caught on the media while the gases pass through the media as a clean gas stream to exit the system through stack 27. A sensor such as a thermocouple may be placed at location 28 or other suitable location on the baghouse to measure the temperature of the gases exiting through stack 27. In addition, another sensor at the same location could be employed to measure the static pressure in the baghouse. Sensor location 39 allows for the placement of a sensor to measure the temperature of the gases and dust entering baghouse 24. The pressure difference between sensor location 39 and sensor location 28 represents a "delta P" that reflects the filtering efficiency of the filter media. A sensor for static pressure can also be placed at sensor location 39. All these sensors are preferably employed to send signals to controller 70 in the machine operator's station 2. Controller 70 may be used to automatically adjust valve 5 of the invention to control the flow of engine exhaust gas into the enclosed space to prevent the temperature of the gas stream entering baghouse 24 from reaching a predetermined level that has been selected to avoid damaging the filter media in the baghouse.

Various types of filter media may be employed, including polyester, Nomex, cotton, pleated fiber, and the like. The shape of the filter media can be round, round with pleats, oval, nearly rectangular, or of other convenient shapes. Preferably, baghouse 24 employs round or pleated bags made of Nomex. To use the space available in the baghouse most effectively, the bags on the forward end of the baghouse (to the left as shown in FIGS. 1-4) are shorter, and the length of the bags increases towards the rear end of the baghouse. A preferred baghouse includes four bags in each of eight rows. The filter area for a baghouse equipped with a plurality of round bags could be approximately 100 $ft^2$, whereas for a baghouse equipped with a plurality of pleated bags, the filter area could approach 200 $ft^2$. For a gas flow to filter area ratio ($ft^3$/minute)/$ft^2$ of 10, the system could handle gas flow of up to 1000 $ft^3$/minute if the baghouse were equipped with round bags, or up to 2000 $ft^3$/minute if equipped with pleated bags.

Various cleaning means are known and used to remove the dust cake from the surface of the media. Two of the more common are jet pulse cleaning using compressed air and atmospheric module cleaning. Preferably, baghouse 24 includes a jet pulse cleaning system. When such a baghouse cleaning system pulses a row of filter bags to clean them, the dust cake released from the filter media falls downward through the opening between enclosure 18 and the baghouse onto the belt of second conveyor 17. Of course, it is contemplated within the scope of the invention that the dust collected could be directed to a location other than second conveyor 17. For example, if the invention were installed on a working machine such as a road stabilizer/reclaimer machine, the dust collected in the baghouse could be directed onto the roadway surface beneath the working machine. In addition, baghouse 24 could be replaced with other filtering devices, including filter houses of various styles and shapes. It could be equipped with any number, style and shape of media and could be cleaned by various methods known to those having ordinary skill in the art to which the invention relates.

The invention facilitates the use of the heat of engine exhaust gases for a useful purpose. In some embodiments of the invention, the direct mixing of engine exhaust gases with other gases in the system can be employed to raise the temperature of such other gases. In the alternative, the invention allows for employing a heat exchanger to extract the heat from engine exhaust gases for use in raising the temperature of other gases in the system. The invention permits the use of the heat of engine exhaust gases, either directly or indirectly, to raise the temperature of other gases which contain dust and condensable gases so that the condensable gases do not condense and cause mudding and plugging of system components. The invention allows for the controlled introduction of engine exhaust gases directly into a milling chamber, and for the use of the space under a conveyor enclosure as a duct for gas transport. The invention also allows for an enclosed space to include the connection in the transfer point between the first and second conveyors so that both the milled material contained on the conveyor belts and the gas and dust entrained in the enclosed space above the belt transfer will be retained within the system. Furthermore, the invention provides low points in the system past which gases are conveyed that are in motion and capable of carrying any dust fall-out. These low points are located in the milling chamber, the first conveyor, the transfer point between conveyors and the second conveyor.

Although this description contains many specifics, these should not be construed as limiting the scope of the invention but as merely providing illustrations of the presently preferred embodiments thereof, as well as the best modes contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A method for operating a working machine which includes:

(a) a drive engine that produces engine exhaust gases;

(b) a milling drum that is mounted for rotation against a road surface thereby generating milled material including dust from the road surface;

(c) an enclosed space within which said milled material is contained;

(d) a spray assembly for directing water in such a manner that, during a period of rotation of the milling drum against the surface of the road, at least a portion of the water is converted to a vapor which is contained within the enclosed space;

(e) an exhaust stack for engine exhaust gases;

(f) a conduit for conducting at least a portion of the engine exhaust gases into the enclosed space;

(g) an exhaust metering valve that is adapted to selectively direct the engine exhaust gases into the conduit for conducting at least a portion of the engine exhaust gases into the enclosed space and/or to the exhaust stack;

(h) a controller that is adapted to operate the exhaust metering valve to control the flow of engine exhaust gases into the enclosed space;

said method comprising:

(i) operating the controller to conduct at least a portion of the engine exhaust gases into the enclosed space to heat the gas stream therein containing vapor and dust from the milled material to a temperature above its dew point.

2. The method of claim 1 which includes conducting the gas stream which has been heated by the engine exhaust gases to a filter device for removal of the dust therefrom.

3. The method of claim 2 which includes the step of controlling the amount of engine exhaust gases that are conducted to the filter device to prevent the temperature of the gas stream entering the filter device from reaching a predetermined level that is selected to avoid damaging the filter device.

4. The method of claim 1 which includes conducting the engine exhaust gases through an exhaust gas treatment device and then conducting at least a portion of the engine exhaust gases from the exhaust gas treatment device into the enclosed space.

5. The method of claim 4 wherein the exhaust gas treatment device is selected from the group consisting of a muffler, a diesel particulate filter and a selective catalytic reactor.

6. A working machine for use in milling the surface of a road, said working machine comprising:

(a) a drive engine that produces engine exhaust gases;

(b) a milling drum that is mounted for rotation against the surface of the road, said milling drum being adapted to generate milled material including dust from the road surface;

(c) a milling chamber within which said milling drum is contained;

(d) a spray assembly for directing water into the milling chamber in such a manner that, during a period of rotation of the milling drum against the surface of the road, at least a portion of the water is converted to a vapor;

(e) an enclosed space which comprises the milling chamber;

(f) a conduit for conducting at least a portion of the engine exhaust gases into the enclosed space to raise the temperature of a gas stream therein containing vapor and dust from the milled material;

(g) an exhaust stack for engine exhaust gases;

(h) an exhaust metering valve that is adapted to selectively direct the engine exhaust gases into the conduit for conducting at least a portion of the engine exhaust gases into the enclosed space and/or to the exhaust stack.

7. The working machine of claim 6:

(a) which includes a first conveyor for carrying milled material from the milling enclosure;

(b) which includes an enclosure for the first conveyor that defines a first enclosed duct through which a gas stream can pass;

(c) wherein the first enclosed duct is in communication with the milling chamber so as to be included along with the milling chamber within the enclosed space.

8. The working machine of claim 7:

(a) which includes a second conveyor for carrying milled material from the forward end of the first conveyor;

(b) which includes an enclosure for the second conveyor that defines a second enclosed duct through which a gas stream can pass;

(c) wherein the second enclosed duct is in communication with the first enclosed duct and the milling chamber so as to be included along with the first enclosed duct and the milling chamber within the enclosed space.

9. The working machine of claim 6 which includes:

(a) a fan that is adapted to create negative pressure within the enclosed space;

(b) a controller that is adapted to operate the exhaust metering valve so that engine exhaust gases will only be directed into the conduit for conducting at least a portion of the engine exhaust gases into the enclosed space when the fan is operating and the milling drum is rotating.

10. The working machine of claim 9:

(a) which includes a filter device that is included within the enclosed space;

(b) wherein the fan is adapted to create negative pressure within the enclosed space and to draw a gas stream from the enclosed space through the filter device.

11. The working machine of claim 10 wherein the controller is adapted to operate the exhaust metering valve to control the flow of engine exhaust gas into the enclosed space to prevent the temperature of the gas stream entering the filter device from reaching a predetermined level that has been selected to avoid damaging the filter device.

12. The working machine of claim 10 wherein the filter device comprises a baghouse having a plurality of filter bags therein.

13. The working machine of claim 12 wherein the filter bags are sized and configured to provide a gas flow to filter area ratio of approximately ten.

14. The working machine of claim 12 wherein the filter bags are arranged in eight rows of four bags each.

15. The working machine of claim 14, wherein the bags on the forward end of the baghouse are shorter, and the length of the bags increases towards the rear end of the baghouse.

16. A working machine for use in milling the surface of a road, said working machine comprising:

(a) a drive engine that produces engine exhaust gases;

(b) a milling drum that is mounted for rotation against the surface of the road, said milling drum being adapted to generate milled material including dust from the road surface;

(c) a milling chamber within which said milling drum is contained;

(d) a spray assembly for directing water into the milling chamber in such a manner that, during a period of rotation of the milling drum against the surface of the road, at least a portion of the water is converted to a vapor;

(e) an enclosed space which comprises the milling chamber;

(f) a conduit for conducting at least a portion of the engine exhaust gases into the enclosed space to raise the temperature of a gas stream therein containing vapor and dust from the milled material;

(g) a first conveyor for carrying milled material from the milling enclosure;

(h) an enclosure for the first conveyor that defines a first enclosed duct through which a gas stream can pass, said first enclosed duct being in communication with the milling chamber so as to be included along with the milling chamber within the enclosed space;

(i) a second conveyor for carrying milled material from the forward end of the first conveyor;

(j) an enclosure for the second conveyor that defines a second enclosed duct through which a gas stream can pass, said second enclosed duct being in communication with the first enclosed duct and the milling chamber so as to be included along with the first enclosed duct and the milling chamber within the enclosed space;

(k) a first gas stream blocking device at the forward end of the second conveyor, which first gas stream blocking device is adapted:

(i) to block a substantial portion of the gas stream above the milled material on the second conveyor;

(ii) to help to keep air at atmospheric pressure from entering the second enclosed duct.

17. The working machine of claim 16 which includes a second gas stream blocking device at the rear end of the second conveyor, which second gas stream blocking device is adapted to block a substantial portion of the gas stream above the milled material on the second conveyor.

18. The working machine of claim 16 which includes a second gas stream blocking device at the forward end of the first conveyor.

* * * * *